United States Patent [19]

Jesionowski

[11] 4,304,047

[45] Dec. 8, 1981

[54] IMPACT CHISEL ATTACHMENT

[76] Inventor: Henry R. Jesionowski, 1437 Chrisler Ave., Schenectady, N.Y. 12303

[21] Appl. No.: 61,118

[22] Filed: Jul. 26, 1979

Related U.S. Application Data

[63] Continuation of Ser. No. 870,536, Jan. 18, 1978, abandoned.

[51] Int. Cl.[3] ..... B26B 7/00

[52] U.S. Cl. ..... 30/277; 30/500

[58] Field of Search ..... 30/277, 500

[56] References Cited

U.S. PATENT DOCUMENTS

| | | | |
|---|---|---|---|
| 1,838,186 | 12/1931 | Moodhe | 30/277 |
| 2,211,741 | 8/1940 | Elwell | 30/277 |
| 3,694,918 | 10/1972 | Bailey et al. | 30/277 |

FOREIGN PATENT DOCUMENTS

| | | | |
|---|---|---|---|
| 1054302 | 10/1953 | France | 30/277 |

*Primary Examiner*—Nicholas P. Godici
*Assistant Examiner*—J. T. Zatarga
*Attorney, Agent, or Firm*—Pollock, Vande Sande & Priddy

[57] ABSTRACT

The present invention relates to a variable stroke, impact device comprising a rotating cam impeller which includes an elongated first end portion adaptable for attachment to a rotary drive source and further includes a curved cam surface formed on a second end portion. The rotating cam surface interacts with a curved end portion of an impact tool to reciprocate a wedge-shaped portion of the tool into contact with a work surface. The length of the stroke and the reciprocating speed as well as the impact force are directly related to the force exerted by the operator in pressing the impact device against the work surface.

8 Claims, 3 Drawing Figures

IMPACT CHISEL ATTACHMENT

This is a continuation of application Ser. No. 870,536, filed Jan. 18, 1978, now abandoned.

BACKGROUND OF THE INVENTION

This invention relates to a new and useful impact device adaptable to being driven by a portable electric drill. The impact device employs a rotating cam impeller to reciprocate a chisel-type tool or bit into intermittent contact with a work surface.

The known portable impact devices produce large amounts of reverse thrust during each impact cycle, which can easily lead to excessive operator fatigue as well as premature failure of the support bearing structure positioned within the impact device and also driving member's thrust-bearings and structure.

As for example, U.S. Pat. No. 2,211,741, issued Aug. 13, 1940, to Elwell, discloses an impact device that is typical of the prior art. The Elwell device uses a compression spring to maintain contact between the drive cam and the reciprocating tool. This requires the operator to exert a pulling force on the handle and attached casing while simultaneously exerting all the pushing force on the drive cam through the attached driving source in order to maintain contact between the drive cam and reciprocating tool. The required push-pull operation quickly fatigues the operator while limiting the total amount of pressure which can be exerted against the work surface through the tool.

The Elwell structure cannot be operated as a variable stroke, impact device because of the action of the biasing spring. Furthermore, the roller bearing assembly attached to the reciprocating tool is susceptible to premature failure due to the large thrust forces generated during impact. Finally, the thrust forces plus the pulling force equal to the spring resistance generated during impact act directly against the drive motor bearings causing damage to both the impact device and the attached drive source.

As will be discussed in detail hereinafter, applicant's new and useful invention solves the problems confronting the prior art, while at the same time providing an inexpensive variable stroke impact device wherein the entire operator pressure is exerted against the work surface through the tool.

OBJECTS OF THE PRESENT INVENTION

An object of the present invention is to provide a variable stroke impact device including a rotating cam impeller which reciprocates an impact tool against a work surface.

A further object of the present invention is to provide an impact device wherein all of the pressure exerted by the operator is directed through the device against the work surface.

Another object of the present invention is to provide an impact device which includes a depth adjustable controlling and restricting screw assembly that prevents the accidental release of the impact tool from its casing, while at the same time limiting the impact tool to reciprocating movement and preventing rotation out of the selected working planes.

Another object of the present invention is to minimize generated reverse thrust forces exerted upon driving member's bearings and structure.

A still further object of the present invention is to provide an impact device which is both inexpensive to manufacture and simple to operate.

These and other objects of the invention will become apparent from a reading of the following specification and claims, together with the accompanying drawings, wherein similar elements are referred to and indicated by similar reference numerals.

BRIEF DESCRIPTION OF THE DRAWINGS

The present invention can be best understood with reference to the accompanying drawings, wherein.

DETAILED DESCRIPTION OF THE PREFERRED EMBODIMENT

Figure 1:
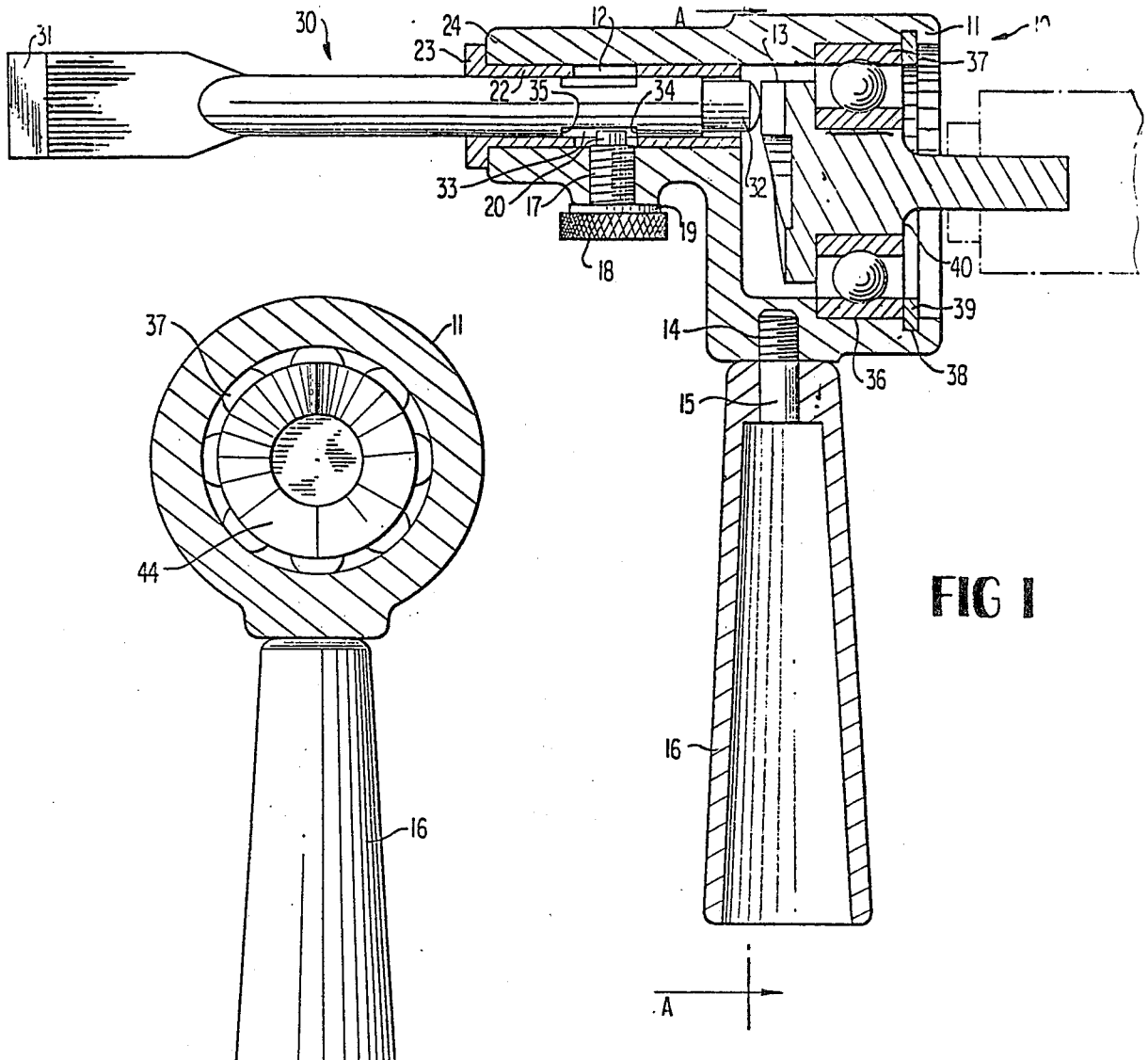
FIG. 1 shows a cross-sectional view of the impact device of the present invention.
Figure 2:
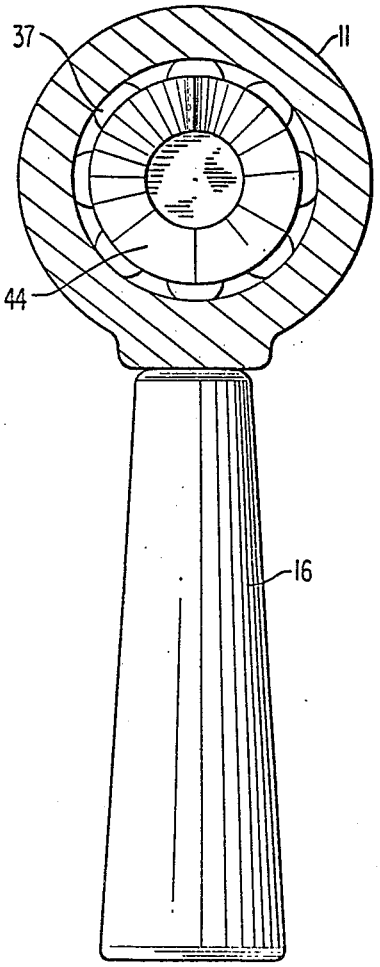
FIG. 2 shows a front view of the preferred embodiment taken along section lines A—A of FIG. 1.

Referring to the drawings, and FIG. 1 in particular, a preferred embodiment of the impact device 10 is shown in cross-section. The impact device 10 comprises a hollow, pistol-shaped casing 11 which includes a transverse bore 12 extending partially therethrough. The bore 12 joins a cylindrical, hollow chamber 13 extending through the remainder of casing 11.

A threaded aperture 14 extends radially through a portion of the wall of casing 11 that surrounds cylindrical chamber 13. A screw member 15 includes a head portion which is integrally attached to a hollow handle 16 and further includes a threaded portion adaptable for engaging threaded aperture 14.

Casing 11 further includes a threaded aperture 17 extending completely through a portion of the wall of casing 11 which surrounds transverse bore 12. A thumb screw 18 is threadable into aperture 17 until a friction tension spring washer 19 surrounding screw 18 is compressed between the head of screw 18 and casing 11. When thumb screw 18 is threaded within its depth adjustment range into aperture 17, an end portion 20 of screw 18 extends into bore 12.

A pair of spaced, cylindrically-shaped, hollow guide bushings 21 and 22 abut the inner cylindrical wall surface of bore 12, and are positioned so as not to block aperture 17. Bushing 22 further includes an L-shaped end portion 23 which abuts an end portion 24 of casing 11 to properly align bushing 22 within bore 12, while preventing foreign particles from passing between bushing 22 and casing 11. Guide bushings 21 and 22 slidably support an integral, impact tool which is generally indicated at 30.

Impact tool 30 includes first and second end portions 31 and 32, respectively. End portion 31 is of a shape to be effective when impacted against a work surface (not shown), while end portion 32 is of a partially spherical shape for a purpose which will be described hereinafter.

Impact tool 30 further includes two, transversely extending notches 33 which are formed in the outer cylindrical surface of tool 30 and positioned nearer end portion 32. The notches 33 may be circumferentially spaced 180 degrees apart, as shown in FIG. 1.

Prior to operation, tool 30 is positioned within bore 12 so that a particular notch 33 is aligned with through aperture 17 allowing the end portion 20 of screw 18 to enter the aligned notch 33. Transverse notches 33 each include radially extending end walls 34 and 35 which are abuttable with screw 18 to limit the sliding motion of tool 30. It is further important to note that the interaction between the end portion 20 of screw 18 and the side walls of the notches 33 prevent rotation of the tool 30 relative to bore 12.

It would, of course, be within the scope of the present invention to form tool 30 with a plurality of circumferentially-spaced, transverse notches 33 allowing the tool 30 to be rotated to a particular angle necessary to insure proper contact between wedge surface 31 and the work surface.

The hollow chamber 13 is formed with an interior wall portion 36 of increased diameter which supports a conventional bearing assembly 37. Interior wall portion 36 includes a cylindrically-shaped groove 38, adaptable for supporting a retaining ring 39. Retaining ring 39 maintains the bearing assembly 37 within chamber 13, while preventing the leakage of lubricating fluid from impact device 10.

Figure 3:
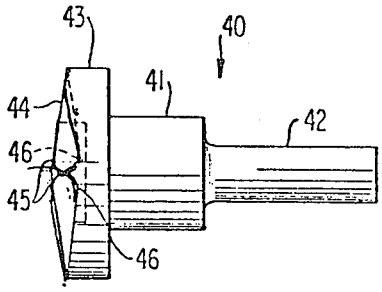
FIG. 3 shows a perspective view of the cam impeller of the present invention.

A cam impeller 40 includes a central hub portion 41 integrally attached to a first elongated cylindrical end portion 42 and a second enlarged cylindrical end portion 43. Elongated portion 42 is adaptable for insertion within an electric drill chuck (phantom), while hub portion 41 is rotatably supportable within bearing assembly 37. Cylindrical end portion 43 includes a curved cam surface 44 comprising a pair of raised cam apexes 45 interconnected with a pair of depressed cam bases 46. As clearly shown in FIG. 3 of the drawings, the portion of curved cam surface 44 extending between each apex 45 and an adjacently disposed cam base 46 is steeply inclined as compared to the much more gradually inclined portion of cam surface 44 extending between each apex 45 and the cam base 46 remotely positioned therefrom. In effect, cam surface 44 forms a series of gradual inclines and abrupt declines between apexes 45 and bases 46.

The operation of the preferred embodiment of the present invention will now be described in detail.

The operator first attaches the impact device 10 to a source of rotating power such as an electric drill by inserting the portion 42 of cam impeller 40 into the electric drill chuck. Next, tool 30 is inserted into bore 12 so as to align a notch 33 with aperture 17. Screw 18 is then inserted through aperture 17 until the end portion 20 of screw 18 enters the particular notch 33.

The impace device is then positioned so that the wedge-shaped end portion 31 of tool 30 is adjacent the work surface. The operator then actuates the electric drill to rotate cam impeller 40 within bearing assembly 37. Interaction between the curved end portion 32 of tool 30 and the curved cam face 44 of impeller 40 forces tool member 30 to slide within guide bushings 21 and 22. The forces generated during impact between the wedge-shaped end portion 31 and the work surface reciprocate the impact tool 30 through cam bushings 21 and 22 causing the end portion 32 to impact against cam surface 44 of cam impeller 40 completing one impact cycle. The continued rotation of impeller 40 causes the impact cycle to be repeated.

A variable stroke effect is produced because the end portion 32 of tool 30 contacts a different portion of the curved cam face 44 of impeller 40 during each impact cycle. The variable stroke drive can be easily controlled because all of the pressure exerted on the casing by the operator is in the direction of the work piece. A light pressure exerted on the handle 16 and attached casing 11 in the direction of the work piece will initiate a light, short and rapid stroke on the part of the impact tool 30, while a heavy pressure on the handle 16 and attached casing 11 generates a more powerful, longer and slower stroke. Because the length, speed and power of the stroke generated by the impact device 10 is directly proportional to the pressure exerted by the operator, the impact device 10 can perform a variety of functions dependent upon the pressure exerted by the operator.

Normally, the impact forces which reciprocate tool member 30 into intermittent contact with impeller 40 tend to reduce the life of bearings 37 as well as the electric motor bearings. But, in the variable stroke arrangement described in applicant's device, the degree of force exerted by the operator on casing 11 in the direction of the work surface reduces by the same degree the reverse impact forces generated during contact between the tool and work surface, resulting in increased bearing life.

Impact device 10 can be easily lubricated by removing screw 18 and introducing lubricant through aperture 17 into bore 12 and chamber 13, respectively. It would be within the scope of the present invention to modify the cam impeller 40 by forming the curved cam surface 44 with more than two interconnected apexes 45 and bases 46.

The present invention is not limited to the above-described embodiment, but is limited only by the scope of the following claims.

What I claim is:

1. A variable force impact device comprising:

a hollow casing assembly including first and second end portions attached to one another, with a bore extending through said first end portion and a hollow chamber extending through said second end portion in joint communication with one another;

a bearing assembly fixedly mounted within the hollow chamber with an impeller assembly rotatably supported and fixedly positioned within said bearing assembly, said impeller assembly including a stem portion extending beyond said hollow casing assembly for releasably engaging a rotatable drive source;

an elongated impact tool supported within and freely slidable through said bore between a first end position wherein a first end portion of said impact tool impacts against said impeller assembly and a second end position wherein a second, opposite end portion of said impact tool impacts against a work surface positioned adjacent to said impact device;

rotatable cam surface means formed on an end portion of said impeller assembly impacting against said first end portion of said impact tool for driving said impact tool through said bore and into contact with said work surface;

said cam surface means comprising a continuous cam surface including cam apexes and cam bases positioned such that said cam surface gradually inclines between each cam base and a respective cam apex circumferentially spaced therefrom and said cam surface abruptly declines between each cam apex and a cam base positioned adjacent thereto, whereby said cam surface defines a substantially saw-tooth shaped configuration;

wherein said continuous saw-tooth cam surface contacts said first end portion of said elongated impact tool and drives said freely slidable elongated tool through said elongated bore with a force directly proportional to a force pressing said casing toward said work surface.

2. An impact device according to claim 1, wherein said first end portion of said elongated impact tool has a partially spherical configuration and the second end portion of said elongated impact tool has a substantially wedge-shaped configuration.

3. An impact device according to claim 1, wherein said cam surface comprises a continuous cam surface integrally formed on the end portion of said impeller assembly, said cam surface including at least two pairs of interconnected cam apexes and cam bases circumferentially spaced from one another, wherein a separate portion of said cam surface extending between each cam apex and one of the cam bases is gradually inclined relative to a plane extending transverse to a longitudinal axis through said impeller assembly, and a further, separate portion extending between each cam apex and a further cam base extends in a direction substantially parallel to said longitudinal axis through said impeller assembly.

4. An impact device according to claim 1, wherein a pair of spaced bushings are each positioned within said bore, with the elongated impact tool extending through said bushings.

5. An impact device according to claim 11, wherein a threaded aperture extends through said first end portion of said hollow casing with said threaded aperture intersecting said bore extending therethrough;

said elongated impact tool including at least one elongated notch formed in an outer surface and extending parallel to a longitudinal axis of said impact tool, with said elongated notch being aligned with said threaded aperture; and a screw assembly including a threaded screw member extending within said threaded aperture, with said screw member having an end portion extending into a portion of said elongated notch to limit reciprocative movement of said impact tool between a first position wherein one end portion of said notch contacts the end portion of said screw member and a second position wherein an opposite end portion of said notch contacts the end portion of said screw member.

6. An impact device according to claim 5, wherein a friction tension spring washer is compressed between an enlarged head portion of said screw member and an outer surface of the first end portion of said hollow casing assembly.

7. An impact device according to claim 5, wherein a plurality of similarly-shaped elongated notches are evenly spaced about an outer circumference of said impact tool, with each notch extending parallel to a longitudinal axis extending through said impact tool and with each notch alignable with said threaded aperture upon rotation of said impact tool.

8. A variable force impact device, comprising:

a casing assembly including an elongated bore extending from one end of said casing into joint communication with an enlarged, substantially cylindrically-shaped chamber extending from an opposite end of said casing;

an impeller hub positioned within said enlarged chamber and including a cylindrically shaped outer surface portion confronting a cylindrically shaped surface portion of said casing forming said chamber;

fixed radial thrust bearing means mounted between and engaging said confronting outer and inner surface portions of said impeller hub and said casing, respectively, for rotatably supporting and fixedly positioning said impeller hub within said chamber, said radial thrust bearing means providing the only thrust support for said impeller hub assembly without any backing plate extending between said casing and said impeller hub assembly;

means for selectively rotating said impeller hub assembly within said radial thrust bearing means;

an elongated impact tool mounted within said elongated bore and including oppositely disposed end portions each aligned with a longitudinal axis extending through said impact tool, said impact tool being freely slidable through said elongated bore between a first position wherein a first end portion of said tool impacts against said impeller hub assembly and a second end position, wherein a second, aligned end portion of said tool impacts against a work surface or the like adjacently disposed to said impact device; and rotatable cam surface means formed on a surface of said impeller hub assembly confronting said first end portion of said elongated impact tool for driving said freely slidable elongated tool through said elongated bore with a force directly proportional to a force pressing said casing toward said work surface.

* * * * *